US007647719B2

(12) United States Patent
Fitzpatrick et al.

(10) Patent No.: US 7,647,719 B2
(45) Date of Patent: Jan. 19, 2010

(54) GUNSTOCKS AND ADAPTERS

(75) Inventors: Richard M. Fitzpatrick, Longmont, CO (US); Michael Mayberry, Denver, CO (US)

(73) Assignee: Magpul Industries Corp., Erie, CO (US)

( * ) Notice: Subject to any disclaimer, the term of this patent is extended or adjusted under 35 U.S.C. 154(b) by 0 days.

(21) Appl. No.: 12/013,357

(22) Filed: Jan. 11, 2008

(65) Prior Publication Data

US 2008/0236016 A1 Oct. 2, 2008

Related U.S. Application Data

(60) Provisional application No. 60/884,617, filed on Jan. 11, 2007.

(51) Int. Cl.
*F41C 23/00* (2006.01)
*F41C 23/20* (2006.01)
*F41A 11/00* (2006.01)

(52) U.S. Cl. ..... 42/71.01; 42/75.03

(58) Field of Classification Search ..... 42/71.01, 42/71.02, 72, 73, 74, 75.03
See application file for complete search history.

(56) References Cited

U.S. PATENT DOCUMENTS

| | | | | |
|---|---|---|---|---|
| 2,900,877 | A * | 8/1959 | McClenahan | 89/173 |
| 3,348,328 | A * | 10/1967 | Roy | 42/73 |
| 6,012,246 | A * | 1/2000 | Robinson et al. | 42/71.01 |
| 6,651,371 | B2 * | 11/2003 | Fitzpatrick et al. | 42/72 |
| 6,729,061 | B1 * | 5/2004 | DeJarnette, Jr. | 42/71.02 |
| 6,874,267 | B2 * | 4/2005 | Fitzpatrick et al. | 42/72 |
| 6,901,691 | B1 * | 6/2005 | Little | 42/118 |
| 6,925,744 | B2 * | 8/2005 | Kincel | 42/71.01 |
| 7,024,812 | B2 * | 4/2006 | Nelson | 42/73 |
| 7,152,355 | B2 * | 12/2006 | Fitzpatrick et al. | 42/73 |
| 2005/0115140 | A1 * | 6/2005 | Little | 42/118 |
| 2005/0268516 | A1 * | 12/2005 | Nelson | 42/73 |
| 2006/0010749 | A1 * | 1/2006 | Kincel | 42/71.01 |

* cited by examiner

*Primary Examiner*—Bret Hayes
(74) *Attorney, Agent, or Firm*—Geoffrey E. Dobbin

(57) ABSTRACT

The present invention is a replacement gunstock assembly for rifles. The assembly comprises a stock body with a uniform mounting structure and one of a series of adapters made to accept the mounting structure and then mount, in turn, on a given rifle platform. Also disclosed is attachment structure for holding the stock body and adapter together, specifically a pair of plates and a set of bores in the modules through which a pair of bolts pass and other interfacing surface geometry.

12 Claims, 10 Drawing Sheets

GUNSTOCKS AND ADAPTERS

CROSS-REFERENCES TO RELATED APPLICATIONS

This Application claims priority as a non-provisional perfection of prior filed U.S. Provisional Application 60/884,617, filed on Jan. 11, 2007 and incorporates the same by reference in its entirety.

FIELD OF THE INVENTION

The present invention relates to the field of firearms and more particularly relates to a gunstock and adapters so that the gunstock may be attached to existing rifle platforms.

BACKGROUND OF THE INVENTION

The present invention is a replacement gunstock for various rifle platforms. It should be noted, that while technically not rifles, the invention may be practiced with other long guns, like shot guns, and the term "rifle" should be read to include any type of personal long gun. Replacement stocks are known in the prior art and are usually made for one particular rifle platform, e.g either the M16/AR15, AK-47, FAL or other existing platforms. However, replacement stocks made for one of these platforms are usually not made for another. As such, adapters are occasionally made to convert one type of stock to fit on another. These adapters typically become a weak point on the rifle or create extra length which makes a rifle more cumbersome. The factor causing these drawbacks is simple, a replacement stock is made and then an adapter is made to accommodate platforms other than the one for which it was created. No replacement stock on the market is made with universal use on rifle platforms in mind.

The present invention represents a departure from the prior art in that the gunstock of the present invention is actually designed from the onset as being used on all platforms. As such it is specially structured to interface with an adapter which is likewise structured for enhanced strength and adaptability to a given platform. The resultant gunstock is therefore stronger, has a better interface with the platform and more ergonomically desirable than replacement gunstocks on the market.

SUMMARY OF THE INVENTION

In view of the foregoing disadvantages inherent in the known types of gunstocks, this invention provides a gunstock designed to be adaptable to any platform without sacrificing strength and ergonomics. As such, the present invention's general purpose is to provide a new and improved gunstock that is adaptable for use on any rifle platform.

To accomplish these objectives, the gunstock comprises a stock body component of any design desired but also having a uniform structured interface for cooperation with an adapter. The invention also comprises an adapter which cooperates with the stock body's interface and presents the stock interface for a given rifle platform. The structure of the adapter and stock component are such that they cooperatively strengthen each other in use, and not merely serve as a means of attaching the stock to a given rifle. As such the ergonomic and durability features of the gunstock as a whole are superior to those found in the prior art.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the gunstock and the adapters therefore are herein described. It should be noted that the articles "a", "an" and "the", as used in this specification, include plural referents unless the content clearly dictates otherwise.

Figure 1:
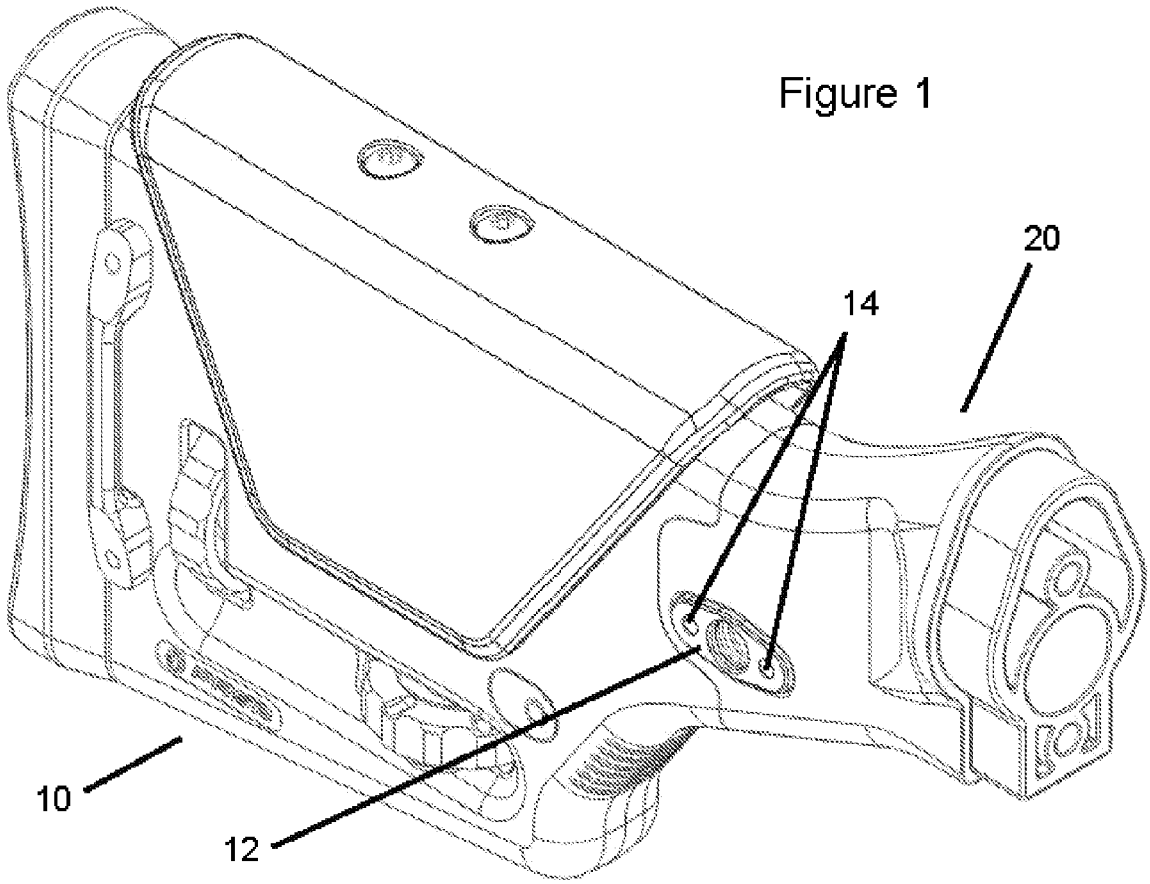
FIG. 1 is a perspective view of a gunstock according to the present invention with an adapter for a G3 style rifle.

With reference to FIG. 1, the whole gunstock system comprises a stock body 10 an adapter 20 and connection means to join them together. In FIG. 1, the adapter 20 is designed for a G3 style rifle and the stock body 10 is a precision rifle stock, or sniper stock. The type of stock body is, in itself, not relevant to the invention, except that whatever type of stock is chosen, the stock body 10 must have structure to interface with the adapter 20. The structure of the stock body is shown in greater detail in FIGS. 6 and 7. Stock body 10 presents the desired features of the chosen stock, in this case adjustable plates 2, 6 and adjustment dials 4, 8 and attachment structure.

The attachment structure of the stock body 10 includes a spur 16 extending from a forward position of the stock body 10 and interfacing grooves 18 to accommodate the adapter 20. Pass through holes 15 and a central bore 17 are located on the spur 16.

The adapter, shown in FIGS. 7-11, comprises a central body 24 and two interfacing ends 22, 26. Hind end 22 interfaces with the stock body 10 with access to sleeve 28 for the spur 16 and a pair of ear like structures 27 that rest within interfacing grooves 18 of the stock body 10. Structure for attachment also includes two sets of pass through holes 21 on either ear structure 27 that correspond to stock body pass through holes 15.

Figure 2:
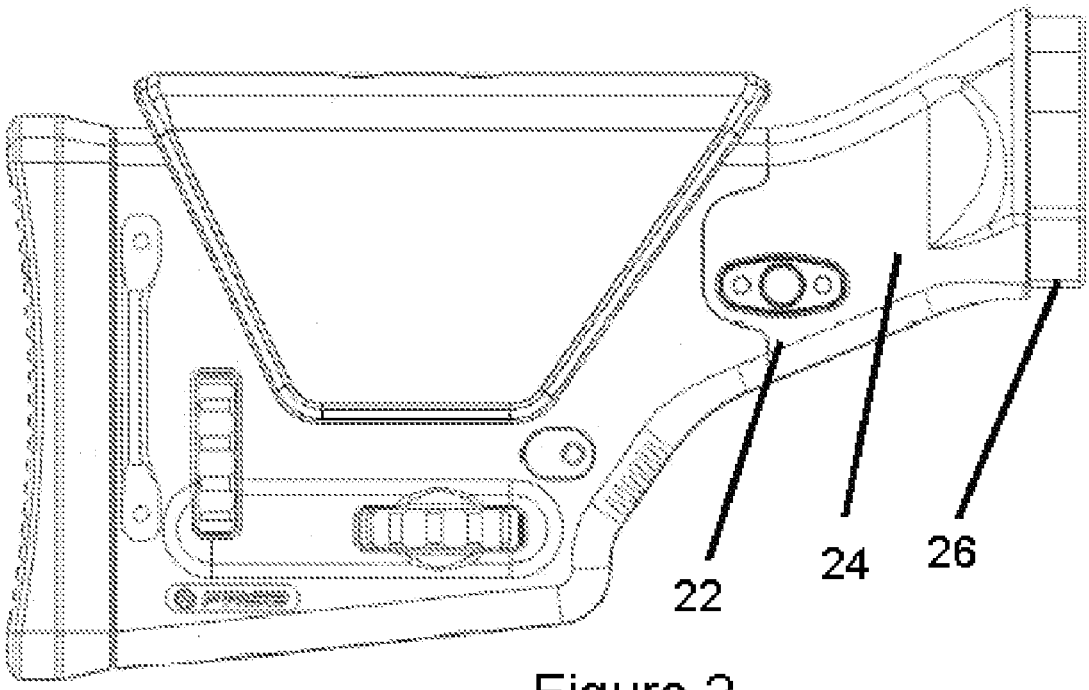
FIG. 2 is a right plan view of the gunstock of FIG. 1.
Figure 3:
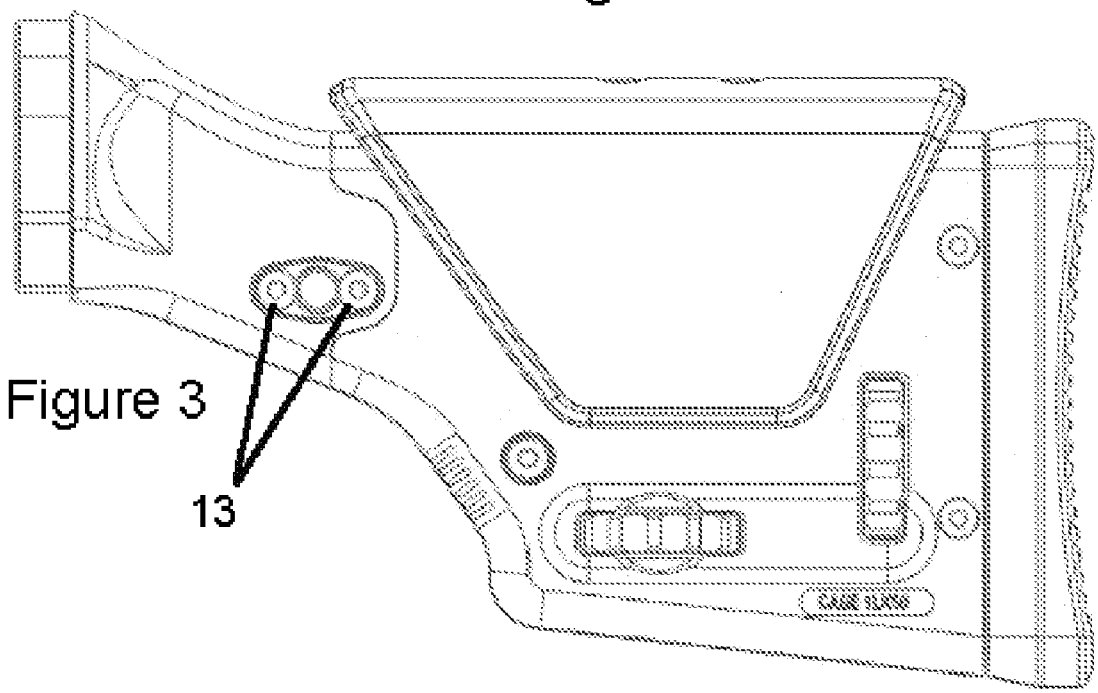
FIG. 3 is a left plan view of the gunstock of FIG. 1.
Figure 4:
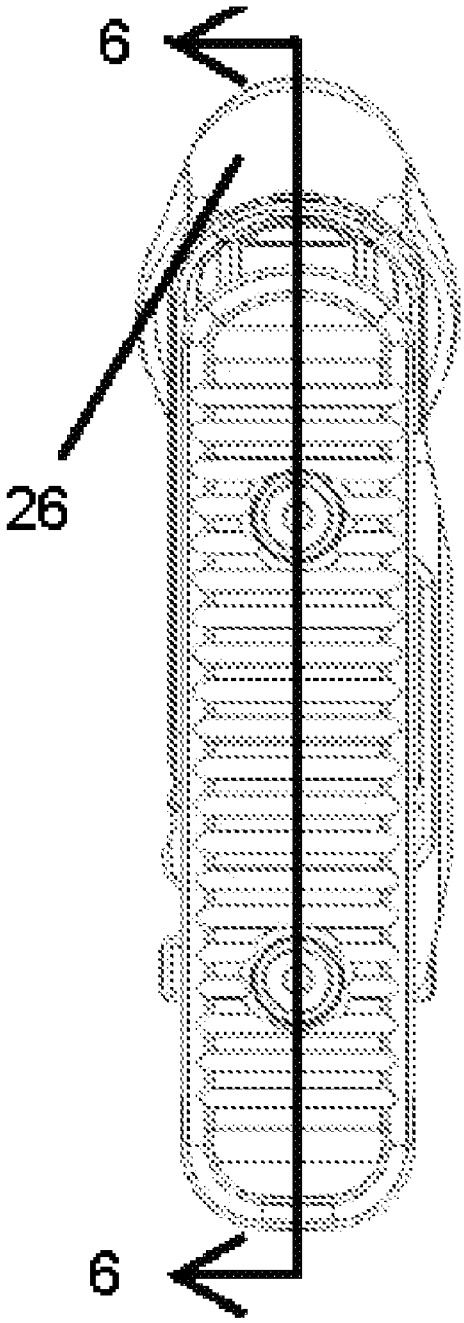
FIG. 4 is a rear plan view of the gunstock of FIG. 1.
Figure 5:
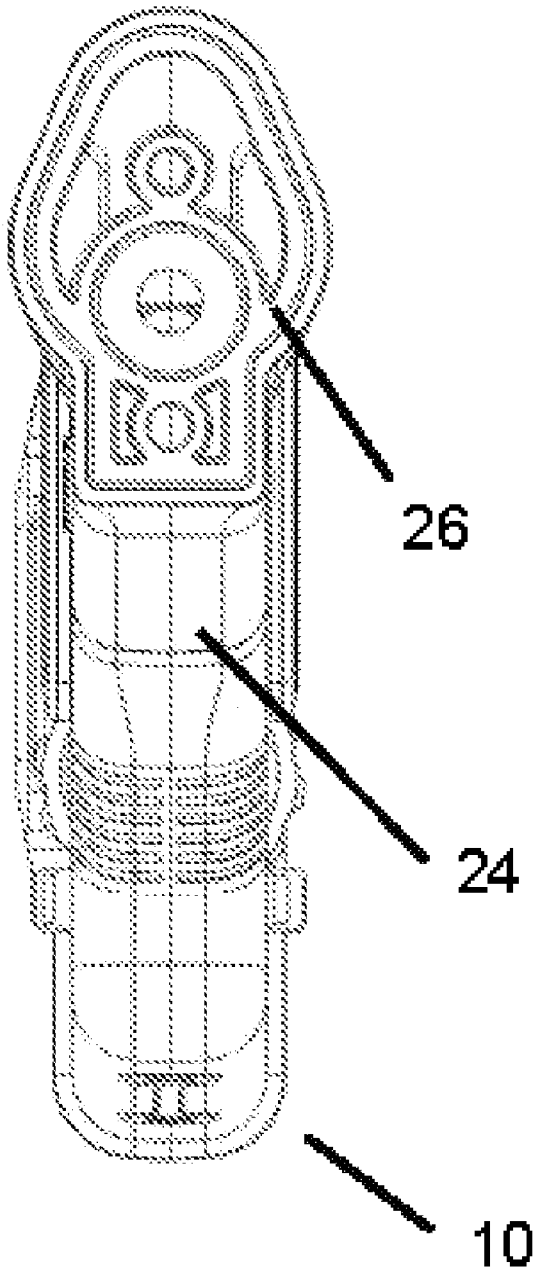
FIG. 5 is a front plan view of the gunstock of FIG. 1.
Figure 6:
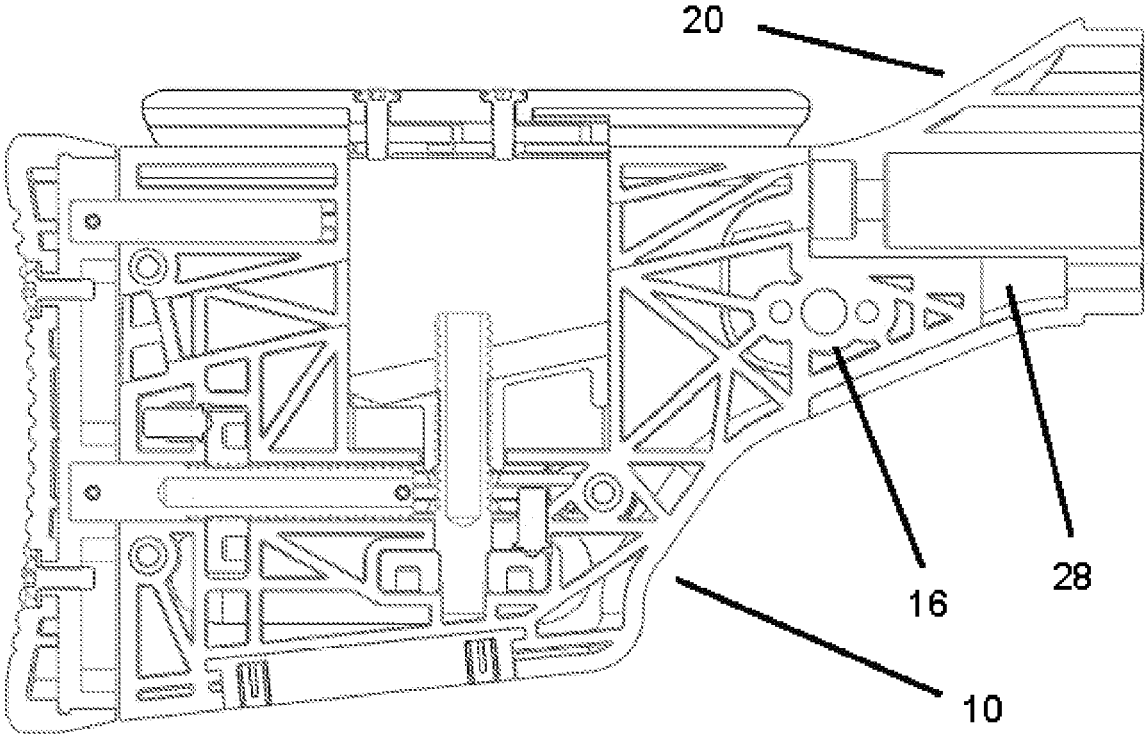
FIG. 6 is a cross-sectional view, taken along line 6-6 of FIG. 4, of the gunstock of FIG. 1.
Figure 7:
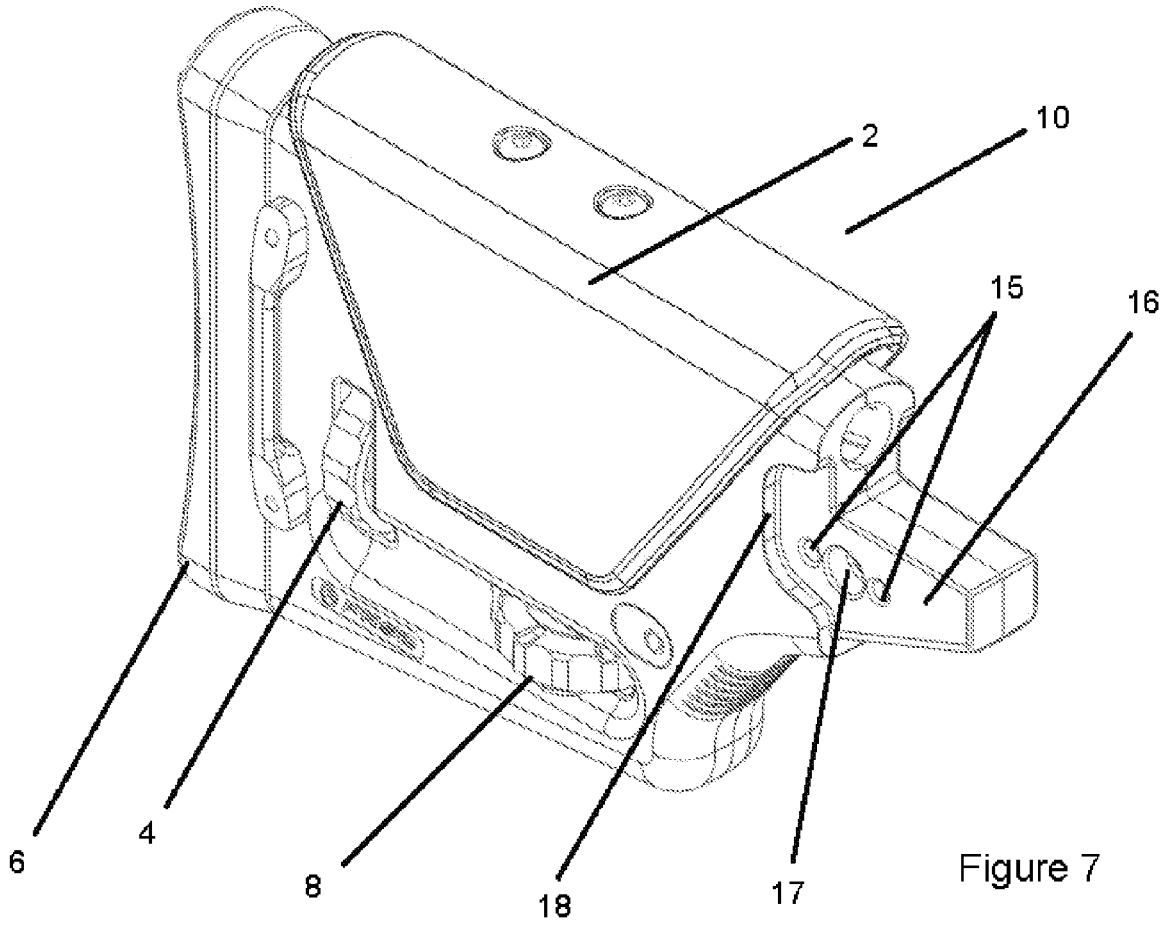
FIG. 7 is a perspective view of just the stock component of the gunstock of FIG. 1.
Figure 8:
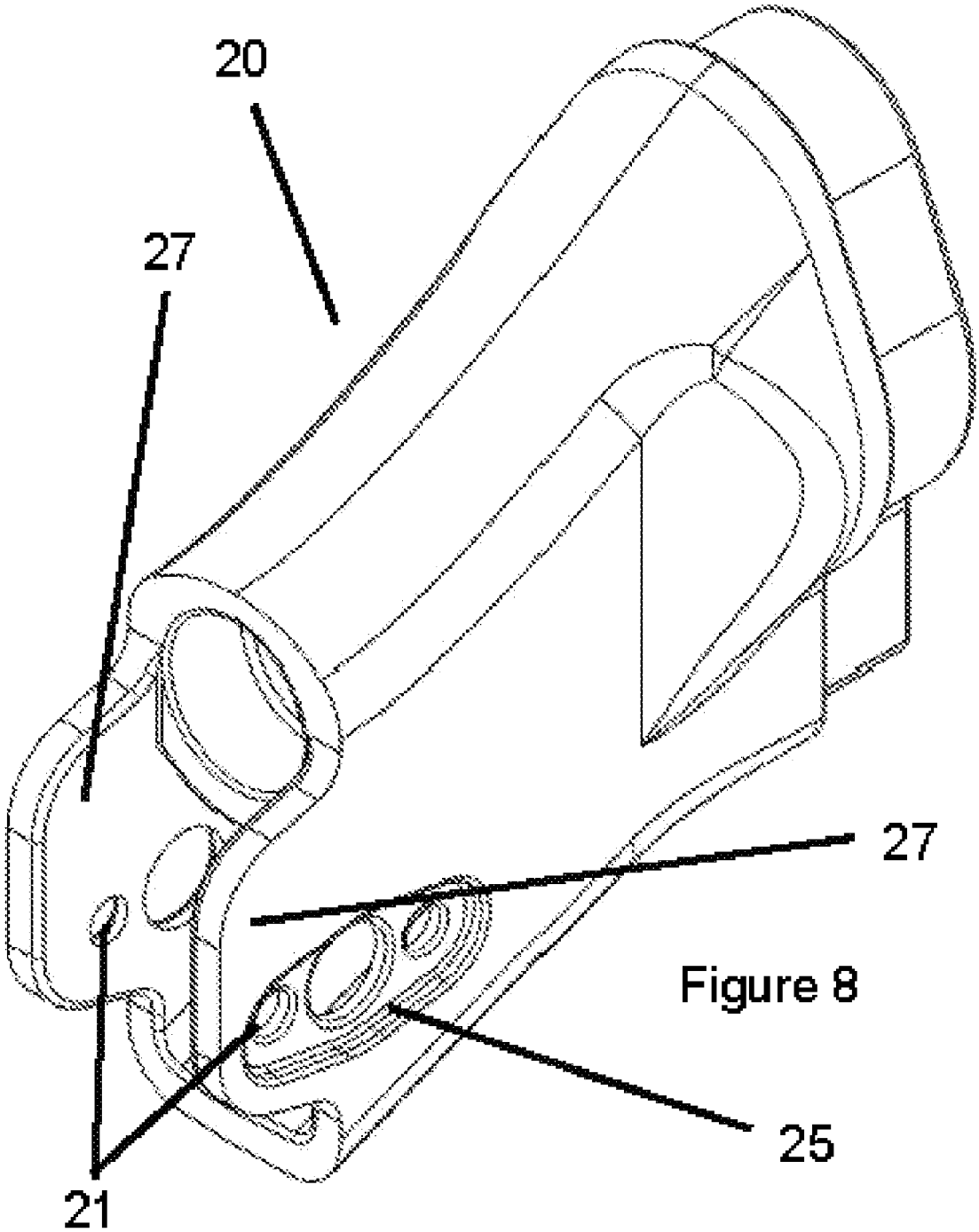
FIG. 8 is a perspective view of the adapter shown in FIG. 1.
Figure 9:
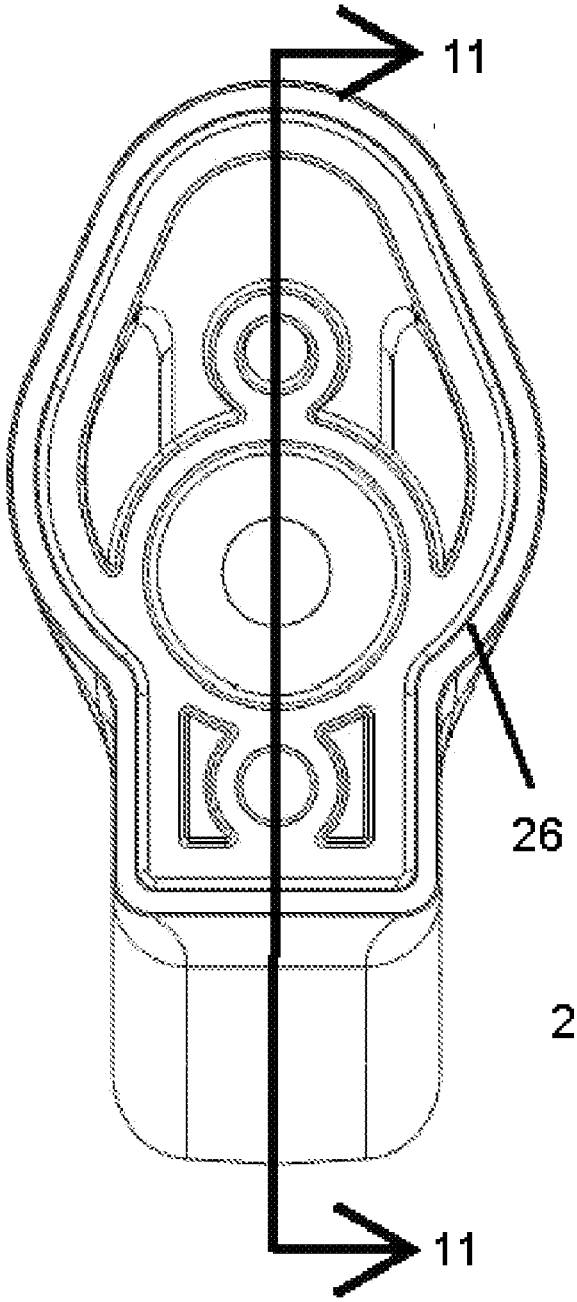
FIG. 9 is a front plan view of the adapter of FIG. 8.
Figure 10:
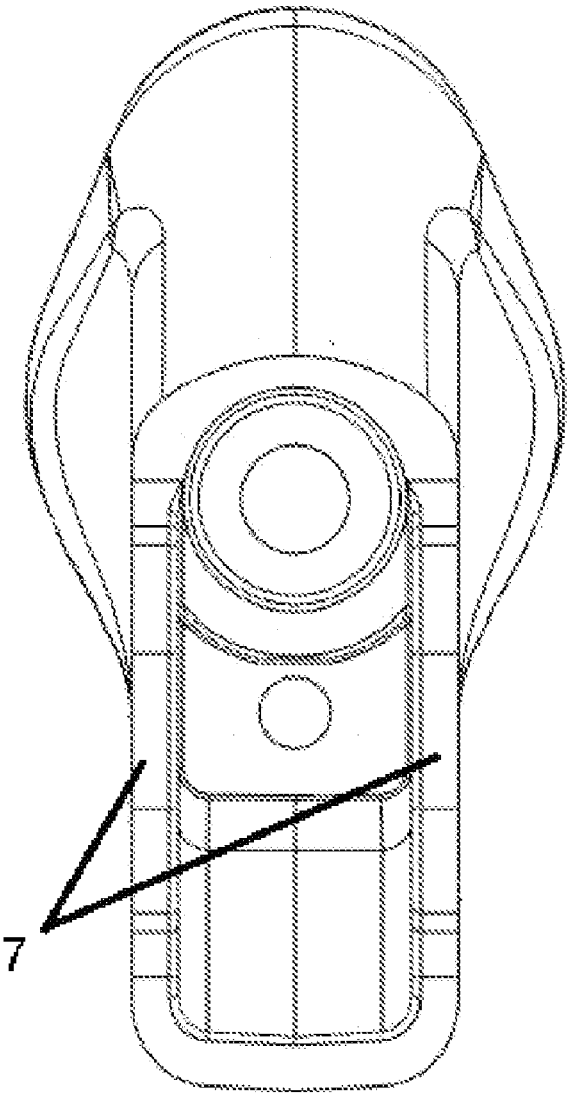
FIG. 10 is a rear plan view of the adapter of FIG. 8.
Figure 11:
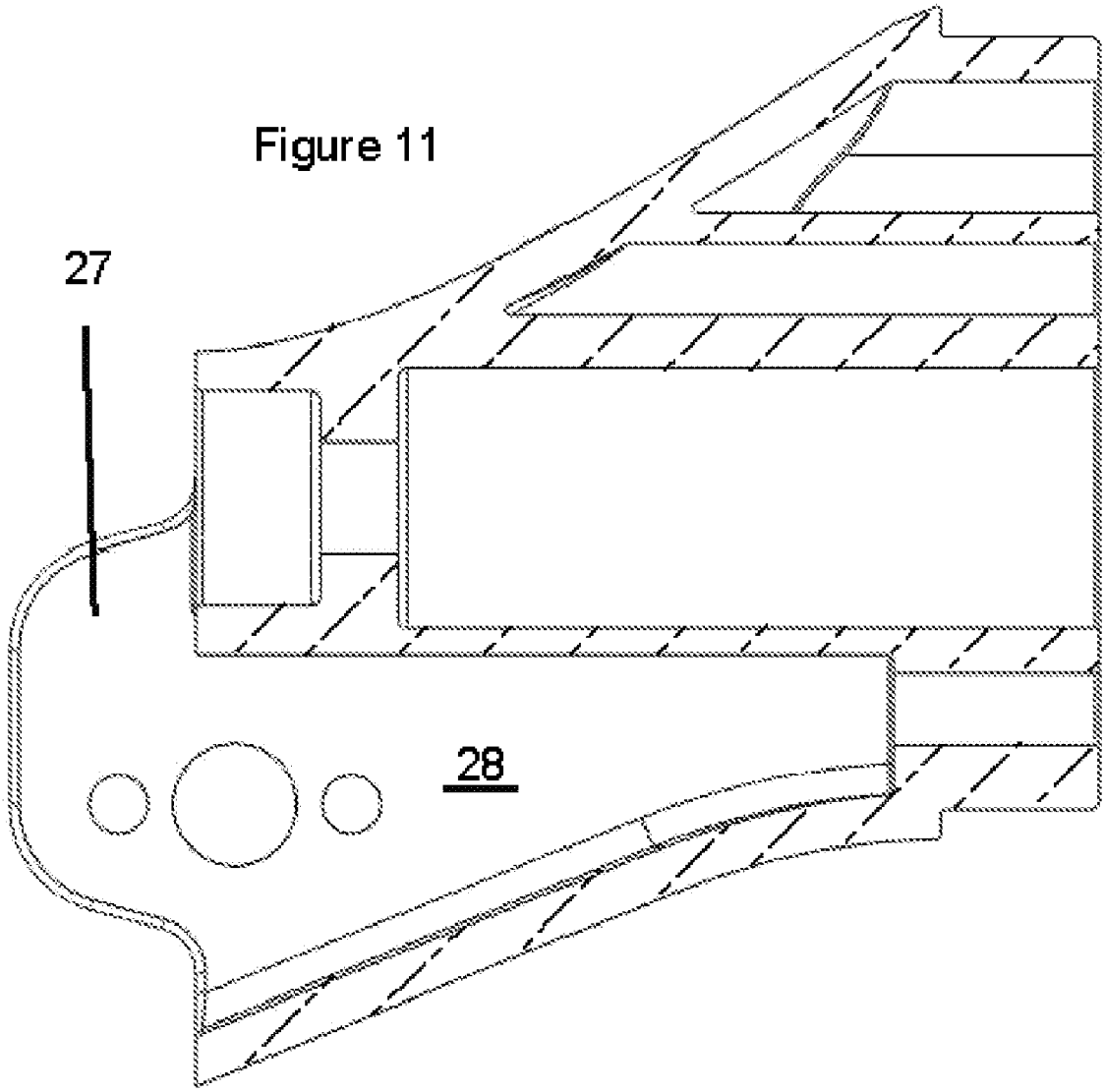
FIG. 11 is a cross-sectional view, taken along line 11-11 in FIG. 9, of the adapter of FIG. 8.

In assembly, the spur 16 is inserted into the adapter 20 through a sleeve 28 located on a distal side of the adapter's main body 24 (FIG. 6). Ear-like projections 27 then rest in cut out surfaces 18 of the stock body when the adapter 20 and stock body 10 are assembled. The preferred connection means is a pair of bolts 14 driven through the pass-through holes of the adapter 21 and of the stock body 15 (FIG. 1) and bracing at least one pressure plate 12 against the adapter hind section 22 (FIG. 2). Opposite the pressure plate 12 is a fastening means 13, shown in FIG. 3. The means depicted are two simple nuts that secure threaded bolt ends. Other possible means are a receiving pressure plate, with threaded bolt holes, or a specialized sling fitting which could provide fastening means. The structures described are usable on either side of the adapter front section 22, which is particularly useful as pass through bore 17 is designed to accommodate a sling fitting in a switchable manner, that is the user may decide for right or left mounting of the sling fitting, and connection means should be likewise adaptable. Ideally, a detent 25 is provided in the adapter 20 to seat the pressure plate 12.

Figure 12:
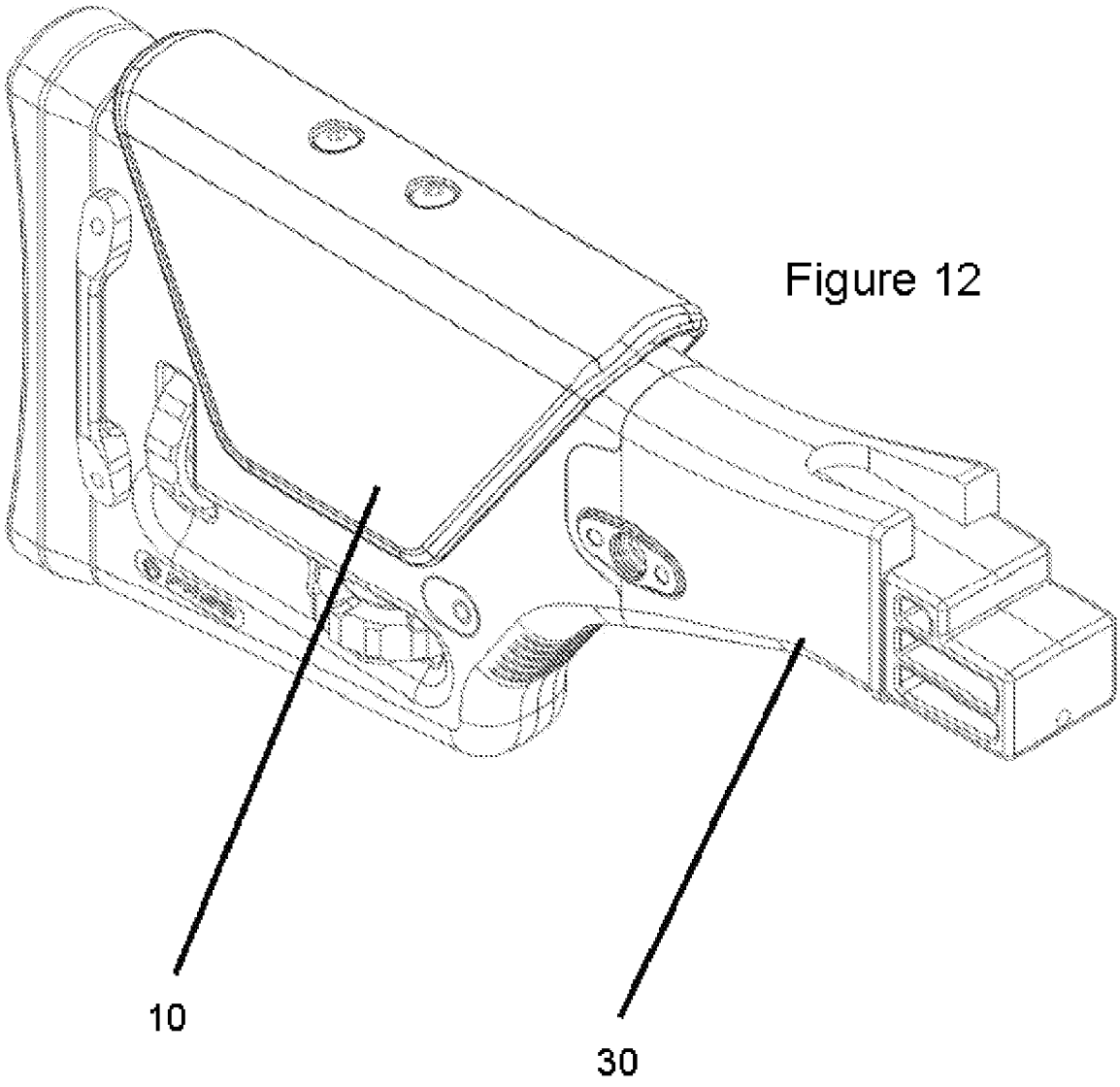
FIG. 12 is a perspective view of the gunstock according to the present invention with an adapter for an AK-47 style rifle.
Figure 13:
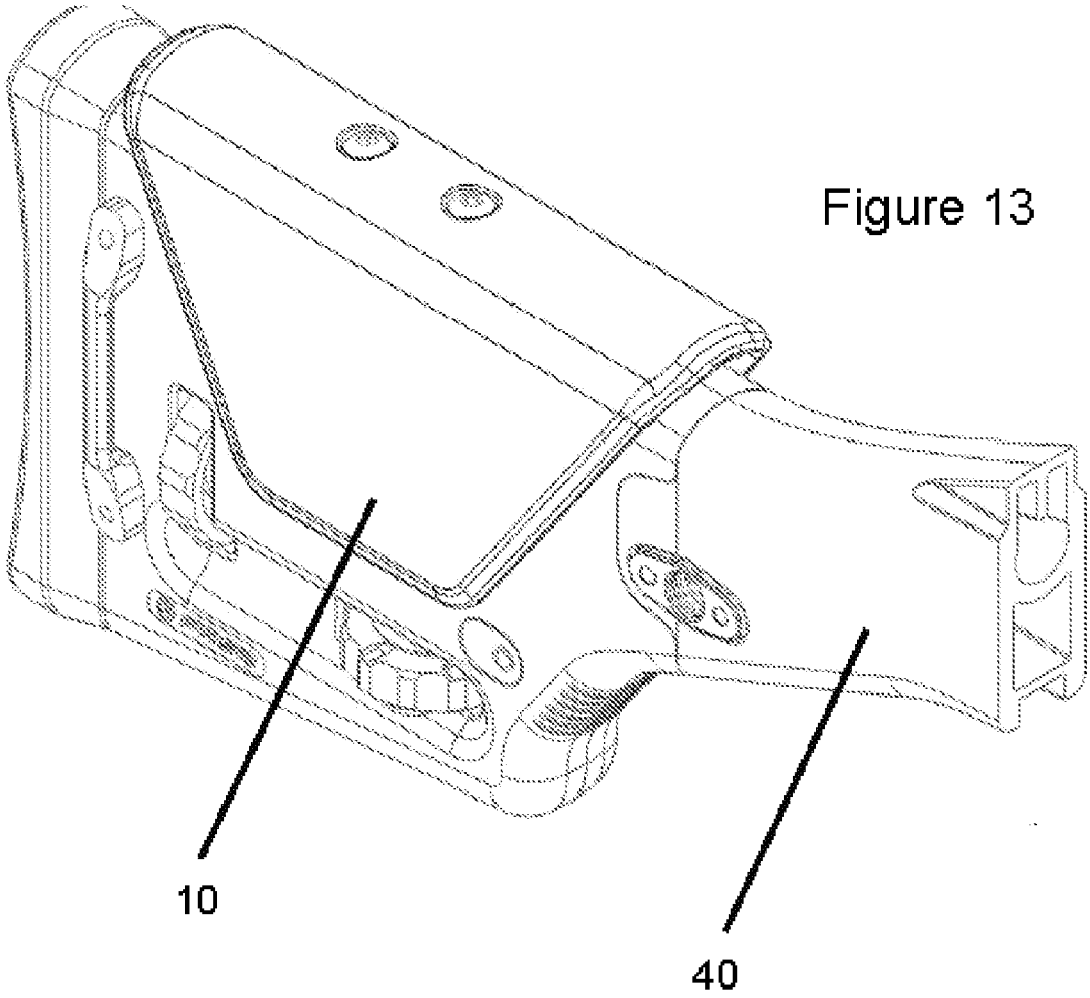
FIG. 13 is a perspective view of the gunstock according to the present invention with an adapter for a FAL style rifle.

Attachment to the rifle is accomplished in regular means for the rifle's stock. Different rifles will require different adapters. Two examples of such are shown in FIGS. 12 and 13, which depict adapters for AK and FAL type rifles respectively. The utility of the invention lies in the fact that the stock body 10 is itself common and made specifically to interact with an adapter as a whole stock for a rifle. As such any adapter, including the G3 adapter 20, the AK adapter 30, the FAL adapter 40, or any other desired to be made, will have the same structures at its hind end 22 while the structure at the fore end 26 will vary with the known structure to attach a regular stock for a given rifle style. As such, instead of creating molds or three or more separate stocks, the stock body of the present invention needs only be made from one mold or procedure while each adapter may then be molded as needed for demand. Each adapter's mold is also much less complicated and smaller than a mold for each stock that the present invention is to replace. Other adapters may of course be made for future platforms or other current platforms such as the AR15.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A modular stock for a firearm comprising:

a. A buttstock module, said buttstock module further comprising:

i. a stock body having forward and rear sides;

ii. a spur, extending from the forward side along a length of the stock body; and iii. at least one bore located upon the spur b. an adapter module further comprising an internal sleeve capable of receiving the spur, said sleeve opening on one side of the adapter module and also having at least one corresponding bolt passage orifice, said adapter module also being capable of mounting on a firearm from an opposite side of the sleeve;

c. at least one bolt capable of passing through the at least one bolt passage orifice of the adapter module and into the bore of the buttstock module.

2. The modular stock of claim 1, the at least one bore being a pair of bores and the at least one bolt being a pair of bolts that pass completely through the bores, the at least one bolt passage orifice numbering four and corresponding to the bores through which the bolts pass, the modular stock further comprising a pair of plates, each abutting one sides of the adapter module about the bolt passage orifices and also through which the bolts pass, thereby securing the adapter module to the buttstock module.

3. The modular stock of claim 2, one plate being an attachment point for a sling.

4. The modular stock of claim 3, the buttstock module and the adapter module each further comprising interfacing surface geometry.

5. The modular stock of claim 4, the adapter module being capable of attaching to rifle platforms selected from the following families of rifle platforms: AR15, AK47, FAL, and G3.

6. The modular stock of claim 3, the adapter module being capable of attaching to rifle platforms selected from the following families of rifle platforms: AR15, AK47, FAL, and G3.

7. The modular stock of claim 2, the buttstock module and the adapter module each further comprising interfacing surface geometry.

8. The modular stock of claim 7, the adapter module being capable of attaching to rifle platforms selected from the following families of rifle platforms: AR15, AK47, FAL, and G3.

9. The modular stock of claim 2, the adapter module being capable of attaching to rifle platforms selected from the following families of rifle platforms: AR15, AK47, FAL, and G3.

10. The modular stock of claim 1, the buttstock module and the adapter module each further comprising interfacing surface geometry.

11. The modular stock of claim 10, the adapter module being capable of attaching to rifle platforms selected from the following families of rifle platforms: AR15, AK47, FAL, and G3.

12. The modular stock of claim 1, the adapter module being capable of attaching to rifle platforms selected from the following families of rifle platforms: AR15, AK47, FAL, and G3.

* * * * *